US006322203B1

(12) United States Patent
Kitahara

(10) Patent No.: US 6,322,203 B1
(45) Date of Patent: Nov. 27, 2001

(54) INK JET RECORDING HEAD AND INK JET RECORDER

(75) Inventor: Tsuyoshi Kitahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/252,217

(22) Filed: Feb. 18, 1999

(30) Foreign Application Priority Data

Feb. 19, 1998 (JP) ..... 10-054381
May 29, 1998 (JP) ..... 10-148703

(51) Int. Cl.[7] ..... B41J 2/045
(52) U.S. Cl. ..... 347/70; 347/68; 347/71
(58) Field of Search ..... 347/70, 71, 68, 347/69, 44, 47

(56) References Cited

U.S. PATENT DOCUMENTS

| | | | | |
|---|---|---|---|---|
| 5,455,615 | | 10/1995 | Burr et al. | 347/92 |
| 5,754,205 | * | 5/1998 | Miyata et al. | 347/70 |
| 6,010,209 | * | 1/2000 | Kitahara | 347/71 |
| 6,137,511 | * | 10/2000 | Furuhata et al. | 347/70 |
| 6,139,132 | | 10/2000 | Yasukawa et al. | 347/70 |

FOREIGN PATENT DOCUMENTS

| | | | | |
|---|---|---|---|---|
| 707961 | | 4/1996 | (EP) . | |
| 761447 | | 3/1997 | (EP) . | |
| 778140 | | 6/1997 | (EP) . | |
| 0761447 A2 | * | 3/1997 | (EP) | 347/70 |
| 9-123448 | | 5/1997 | (JP) . | |

* cited by examiner

*Primary Examiner*—John Barlow
*Assistant Examiner*—An H. Do
(74) *Attorney, Agent, or Firm*—Sughrue, Mion, Zinn, Macpeak & Seas, PLLC

(57) ABSTRACT

An ink jet recording head which has a flow passage formation substrate including a reservoir, a first ink supply port formed on a face opposed to an elastic plate, a second ink supply port formed on a face opposed to a nozzle plate, first and second pressure generation chambers communicating with the reservoir through the first and second ink supply ports, and a nozzle communication hole spread and opened to the nozzle opening side to allow the first and second pressure generation chambers to communicate with each other, a nozzle plate having a nozzle opening for sealing one face of the flow passage formation substrate, the elastic plate for sealing an opposite face of the flow passage formation substrate, and pressure generator for pressurizing the pressure generation chambers.

39 Claims, 12 Drawing Sheets

INK JET RECORDING HEAD AND INK JET RECORDER

BACKGROUND OF THE INVENTION

1. Field of the Invention

This invention relates to an ink jet recording head for elastically deforming an elastic plate forming a pressure generation chamber by a piezoelectric vibrator and jetting ink in the pressure generation chamber as an ink drop through a nozzle opening and more particularly to a structure of a flow passage formation substrate.

2. Description of the Related Art

An ink jet recording head is designed for pressurizing a pressure generation chamber communicating with a common ink chamber and a nozzle opening by pressure generation means, such as a heating element provided in the pressure generation chamber or a piezoelectric vibrator provided so as to be able to deform a part of the pressure generation chamber, for jetting ink drops.

For example, JP-A-9-123448 proposes an ink jet recording head wherein a substrate is formed on both faces with first and second pressure generation chambers as concaves, wherein each pressure generation chamber is provided with first and second ink supply ports as slightly narrowed concaves communicating with a reservoir, and wherein a nozzle communication hole in the form of a through hole is made in an area opposed to the nozzle opening.

In this type of recording head, the pressure generation chamber volume can be made small and minute ink drops fitted to graphics print can be jetted. In addition, the through hole occupying the substrate is small and rigidity can be provided, thus the substrate can be made thin and it is possible to shorten the etching time and reduce material costs.

However, as shown in FIG. 18, since substrate 100 is formed on both faces with first and second flat pressure generation chambers 41 (not shown) and 103, when a nozzle opening 103 is sealed with a cap and negative pressure is made to act on the nozzle opening 103 from the outside for forcibly discharging ink for recovering ink drop jet performance, the flow velocity of ink flowing into the pressure generation chamber 41, 102 from reservoir 104 easily decreases. Thus, bubbles easily accumulate particularly in the pressure generation chamber 41 on the piezoelectric vibrator 105 side. Since the bubbles absorb pressure applied by the piezoelectric vibrator, as is known, the ink drop jet capability lowers, degrading print quality. In FIG. 18, numerals 106 and 107 denote first and second ink supply ports.

Since the pressure generation chambers become shallow as compared with the case where the pressure generation chamber is formed as a single chamber, flow passage resistance of the pressure generation chamber is large and ink supply from the reservoir to the pressure generation chamber is delayed, slowing down drive speed.

SUMMARY OF THE INVENTION

According to the invention, there is provided an ink jet recording head comprising a flow passage formation substrate comprising a reservoir, a first ink supply port formed on a face opposed to an elastic plate, a second ink supply port formed on a face opposed to a nozzle plate, first and second pressure generation chambers communicating with the reservoir through the first and second ink supply ports, and a nozzle communication hole made so as to be spread and opened to the nozzle opening side so as to allow the first and second pressure generation chambers to communicate with each other, a nozzle plate having a nozzle opening for sealing one face of the flow passage formation substrate, the elastic plate for sealing an opposite face of the flow passage formation substrate, and pressure generation means for pressurizing the pressure generation chambers.

Thus, when the nozzle plate is sealed with a cap and negative pressure is made to act on the nozzle plate, the nozzle communication hole spread and opened to the nozzle opening side causes the flow velocity of ink to increase in the proximity of the nozzle communication hole and bubbles accumulating in the first pressure generation chamber can be promptly moved to the second pressure generation chamber on the nozzle opening side and can be reliably discharged.

Since flow passage resistance and inertance of the nozzle communication hole can be held at low values, a pressure wave occurring after an ink drop is jetted can be allowed to rapidly pass through the nozzle communication hole for improving the response speed and ink drop jet stability.

It is therefore a first object of the invention to provide an ink jet recording head capable of preventing bubbles from accumulating in a pressure generation chamber while improving ink supply to the pressure generation chamber.

It is a second object of the invention to provide an ink jet recorder comprising the ink jet recording head.

DESCRIPTION OF THE PREFERRED EMBODIMENTS

Figure 1:
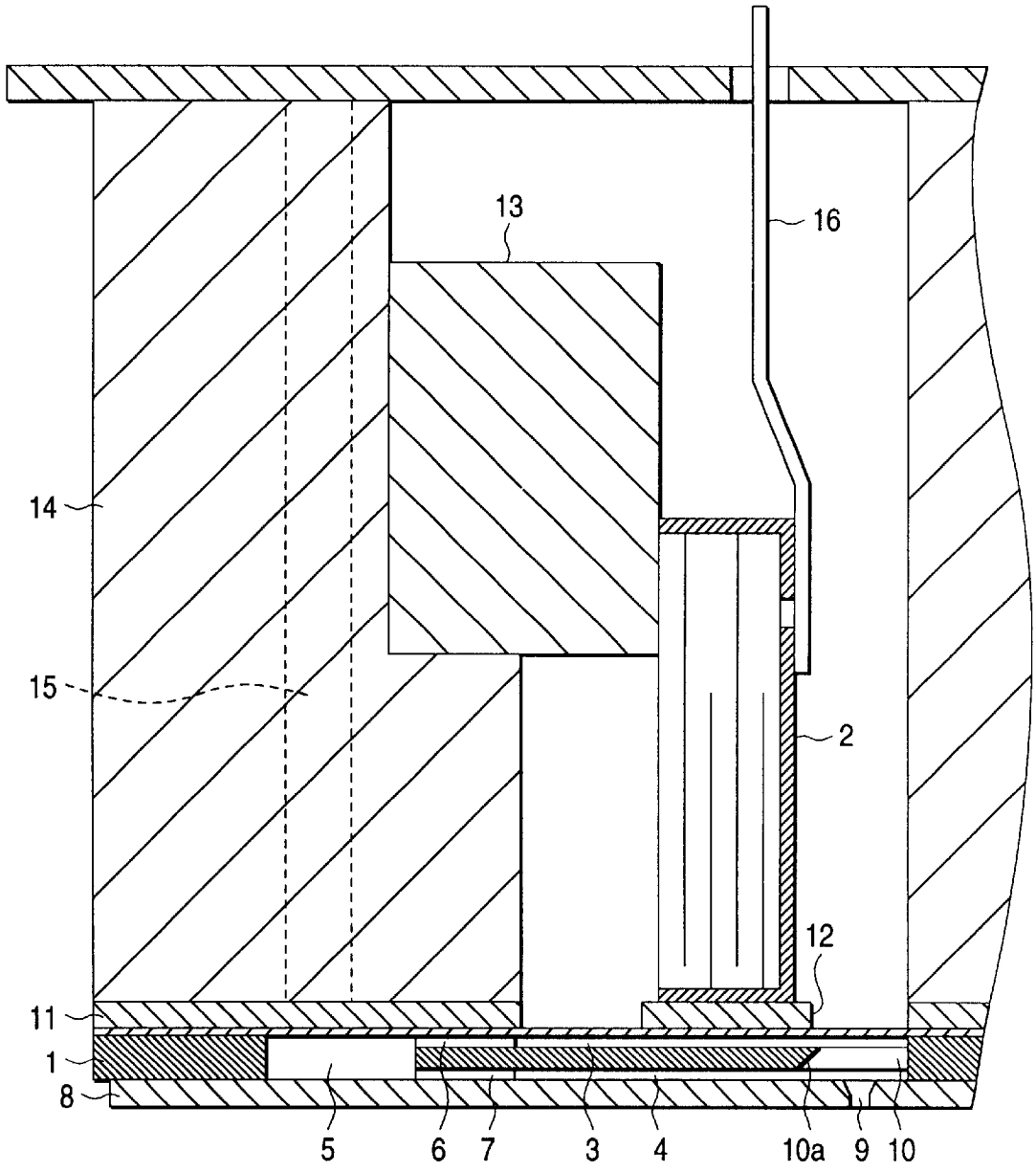
FIG. 1 is a drawing to show one embodiment of the invention as a cross-sectional structure on the center line of adjacent pressure generation chambers.
Figure 2:
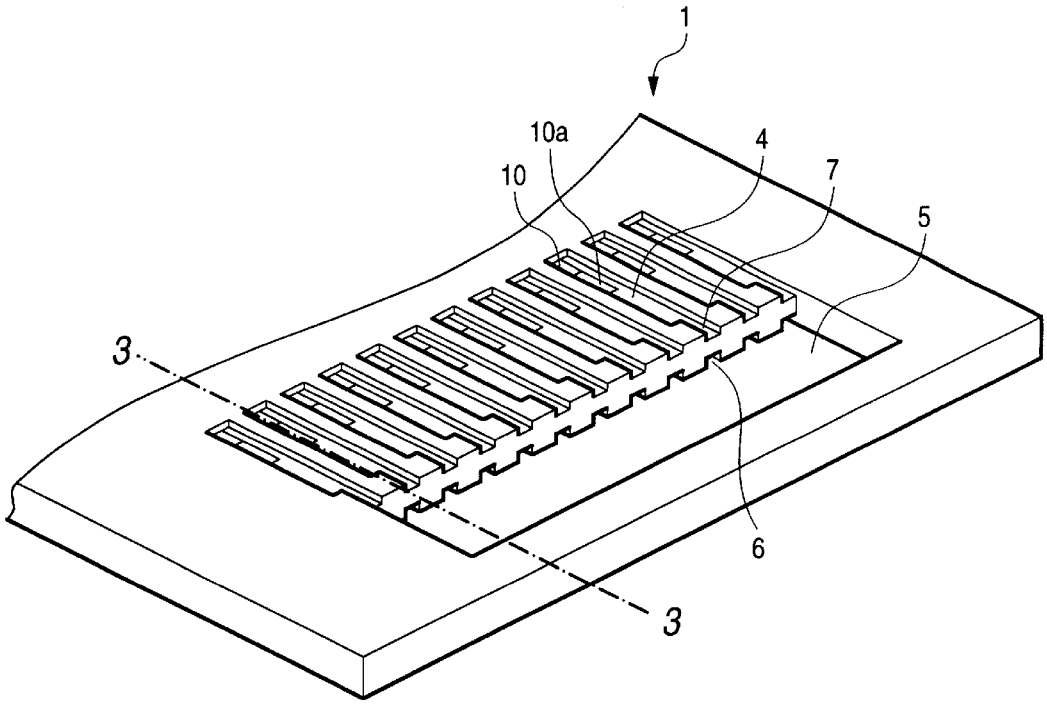
FIG. 2 is a perspective view to show one embodiment of a flow passage formation substrate forming a part of a recording head.
Figure 3:
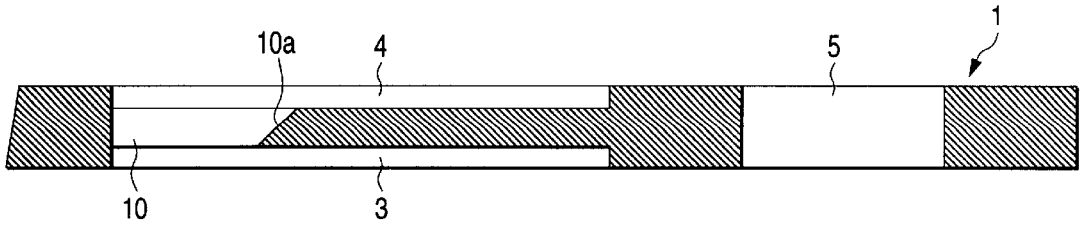
FIG. 3 is a sectional view taken on line 3—3 in FIG. 2.

FIG. 1 shows one embodiment of the invention as a cross-sectional structure on the center line of adjacent pressure generation chambers. A flow passage formation substrate 1 is formed on both faces of an area opposed to a piezoelectric vibrator 2 with first and second pressure generation chambers 3 and 4 as shallow concaves by half etching as shown in FIGS. 1 and 2. A reservoir 5 made of a through hole is formed on one side of the pressure generation chambers 3 and 4 and communicates with the pressure generation chambers 3 and 4 through ink supply ports 6 and 7.

A nozzle communication hole 10 in the form of a through hole for making the first and second pressure generation chambers 3 and 4 communicate with each other is made in the proximity of a nozzle opening 9 of a nozzle plate 8. The nozzle communication hole 10 is formed as a through hole spread and opened to the nozzle opening side so that the opening area on the piezoelectric vibrator side is small, that the opening area on the nozzle opening side is large, and that preferably both opening areas are connected by a smooth slope 10*a*.

The flow passage formation substrate 1 can be formed, for example, by a method of executing anisotropic etching of a silicon monocrystalline substrate for forming concaves and through holes or a method of etching a metal plate of stainless steel, etc., for forming concaves and through holes.

The flow passage formation substrate 1 has the face on the side of the first pressure generation chamber 3 sealed with an elastic plate 11. At almost the center of the pressure generation chamber 3, pressure generation means (in the embodiment, a piezoelectric vibrator 2 of a piezoelectric constant d31 axially expanded and contracted) is abutted at the tip against an island part 12 formed in the elastic plate 11 and is fixed at an opposite end to a head frame 14 via a fixed substrate 13.

In the structure, a drive signal is supplied to the piezoelectric vibrator 2 for contracting or expanding the piezoelectric vibrator 2, whereby the elastic plate 11 becomes elastically deformed and the first pressure generation chamber 3 is expanded or contracted. As the first pressure generation chamber 3 is expanded, ink in the reservoir 5 is sucked into the pressure generation chambers 3 and 4; as the first pressure generation chamber 3 is contracted, ink in the pressure generation chambers 3 and 4 is pressurized and is jetted through the nozzle opening 9 as an ink drop.

In FIG. 1, numeral 15 denotes an ink supply passage for guiding ink in an external ink tank into the reservoir 5 and numeral 16 denotes a flexible cable for supplying a drive signal to the piezoelectric vibrator 2.

In the embodiment, when a drive signal is applied to the piezoelectric vibrator 2 for charging, the piezoelectric vibrator 2 is contracted and the volume of the first pressure generation chamber 3 expands. As the first pressure generation chamber 3 is expanded, ink in the reservoir 5 flows into the first and second pressure generation chambers 3 and 4 through the first and second ink supply ports 6 and 7 and a necessary amount of ink for printing is supplied to the first and second pressure generation chambers 3 and 4.

Next, when the piezoelectric vibrator 2 is discharged, it is expanded to the former state and reduces the volume of the first pressure generation chamber 3, and ink in the first and second pressure generation chambers 3 and 4 is pressurized and is jetted via the nozzle communication hole 10 through the nozzle opening 9 as an ink drop.

If the print operation thus performed continues for hours, as the pressure generation chamber 3 is expanded and contracted, air is sucked through the nozzle opening 9 and bubbles are deposited in the proximity of the nozzle opening 9 and enter the first and second pressure generation chambers 3 and 4. In such a case, a cap member (not shown) is brought into intimate contact with the nozzle plate 8 and negative pressure is made to act on the nozzle opening 9 by a suction pump for forcibly discharging ink through the nozzle opening 9.

Figure 4:
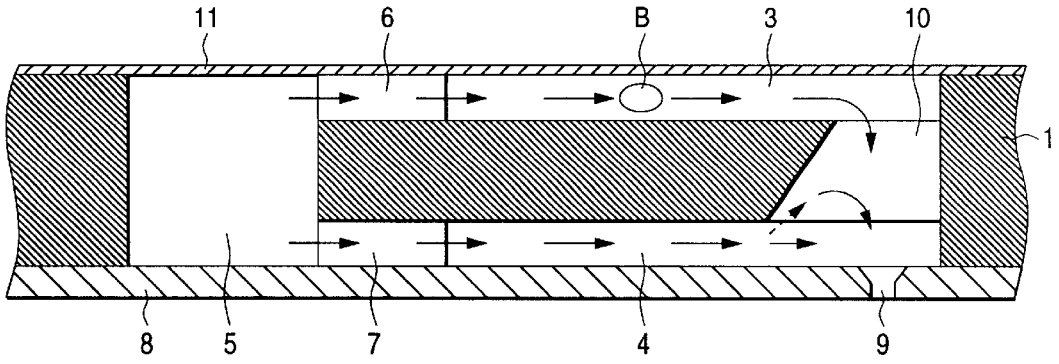
FIG. 4 is a drawing to show ink flow when ink is forcibly discharged from the nozzle opeinig.

At this time, the first pressure generation chamber 3 communicates with the nozzle opening 9 via the nozzle communication hole 10 spread and opened to the nozzle opening side. Thus, the flow velocity increases in the proximity of the nozzle communication hole 10 as shown in FIG. 4, whereby bubble B accumulating in the first pressure generation chamber 3 existing at a position remote from the nozzle opening 9 also moves rapidly to the second pressure generation chamber 4, is collected at a position near the nozzle opening 9, is carried on the ink flow, and is easily discharged through the nozzle opening 9 to the outside.

In the invention, since the nozzle communication hole 10 is trapezoidal in cross section, the opening area on the first pressure generation chamber 3 side is narrowed and the nozzle effect causes the ink flow velocity to increase at the forcible discharge time for improving dischargeability of bubbles, and it is possible to hold flow passage resistance and inertance at low values. Therefore, a pressure wave occurring after an ink drop is jetted can be allowed to pass through the nozzle communication hole 10 without resistance for improving the response speed and providing ink drop jet stability.

Figure 5:
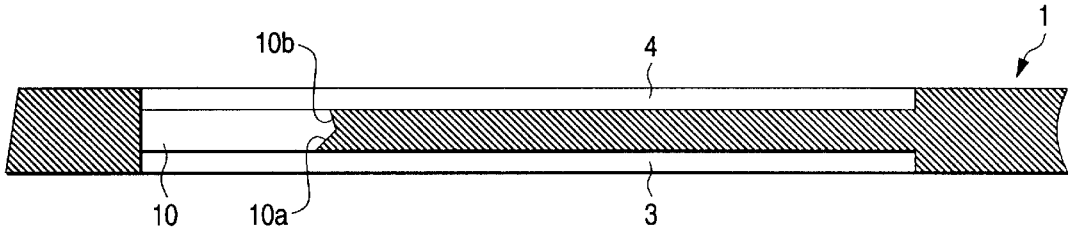
FIG. 5 is a sectional view to show another embodiment of the invention as a structure of a flow passage formation substrate.

In the embodiment, the spread and open part of the nozzle communication hole 10 is formed as a single slope, but if it is formed as a slope part la spread from the second pressure generation chamber 4 to the first pressure generation chamber 3 and a vertical face part 10*b* as shown in FIG. 5, a similar effect is produced.

Figure 6:
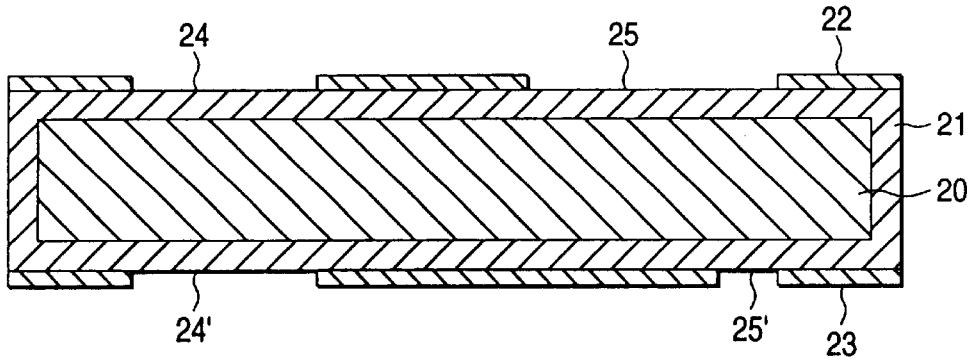
FIGS. 6A to 6D are drawings to show the first half of a flow passage formation substrate manufacturing steps.
Figure 6:
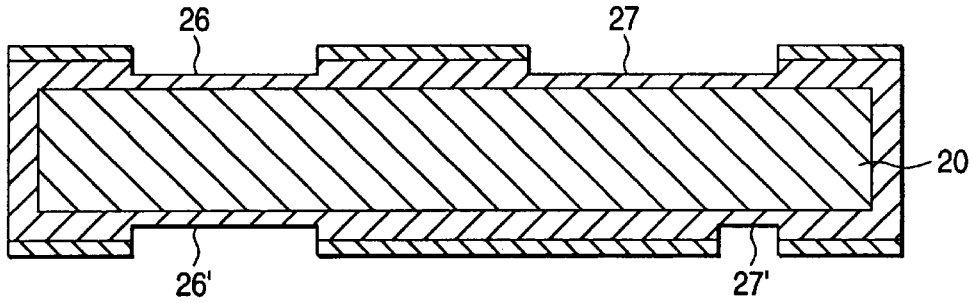
Figure 6:
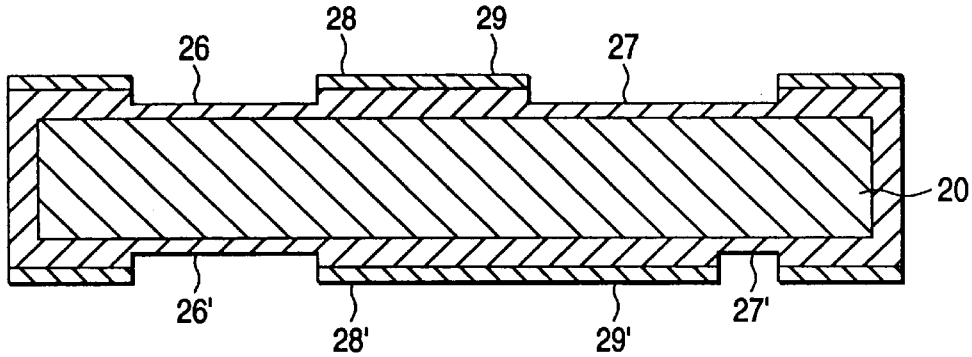
Figure 6:
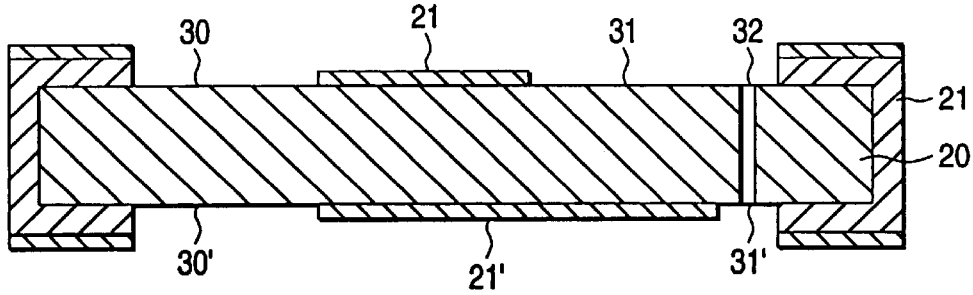
Figure 7:
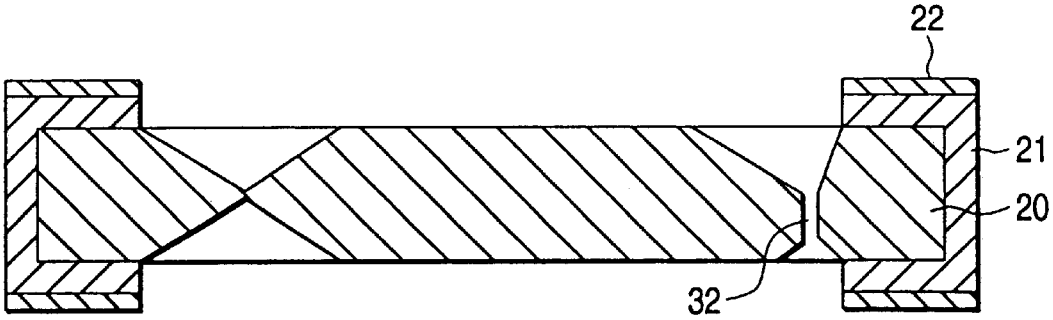
FIGS. 7A to 7C are drawings to show the latter half of the flow passage formation substrate manufacturing steps.
Figure 7:
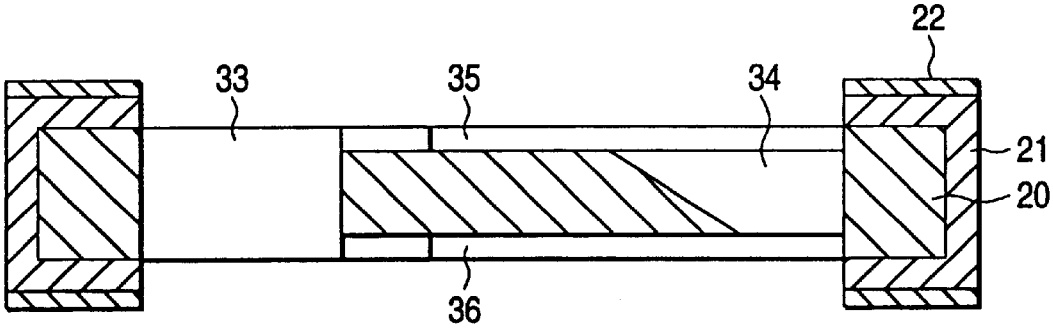
Figure 7:
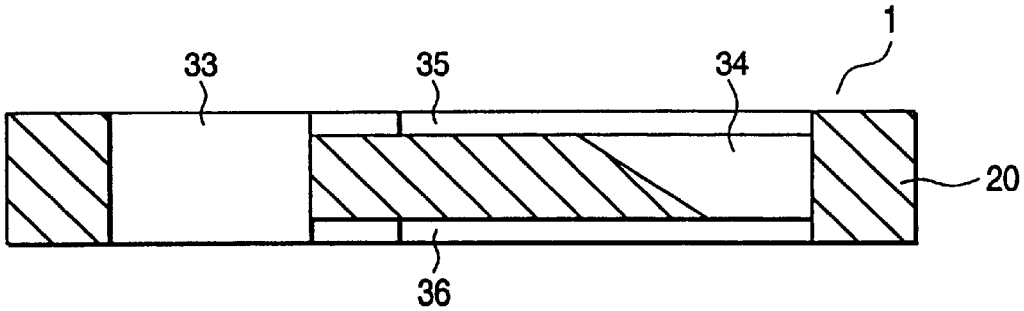

Next, a manufacturing method of the above-described flow passage formation substrate 1 will be discussed with reference to FIGS. 6 and 7.

A silicon oxide film 21 as an etching protective film is formed 1 $\mu$m thick by a thermal oxidation method on the full face of a <110> plane orientation silicon monocrystalline substrate 20 having a thickness of about 300 $\mu$m to 600 $\mu$m which is easily handled.

Further, a photo-resist agent is applied to both faces by a spin coat method, etc., for forming photo-resist layers 22 and 23, and windows 24 and 24' and resist patterns 25 and 25', which become the reservoir 5 formed as a through hole and the nozzle communication hole 10, respectively, are formed on both surfaces (FIG. 6I). The patterns 25 and 25' of the nozzle communication hole 10 are matched in an end face to the nozzle opening and one face (in the figure, the upper face side) is formed large in response to the areas to be opened in the faces.

The silicon monocrystalline substrate 20 formed with the etching windows 24 and 24' and 25 and 25' in the resist layers 22 and 23 is immersed in a buffer hydrofluoric acid solution and the patterns corresponding to the windows 24 and 24' and 25 and 25' are transformed to half etching layers 26 and 26' and 27 and 27' of the silicon oxide film 21 (FIG. 6II).

Next, areas becoming the first and second pressure generation chambers 3 and 4 and the ink supply ports 6 and 7 are exposed and developed for forming patterns 28 and 28' and 29 and 29' of the pressure generation chambers 3 and 4 and the ink supply ports 6 and 7 on both faces (FIG. 6III). Again the silicon monocrystalline substrate 20 is immersed in the buffer hydrofluoric acid solution and etching is executed until the patterns 26 and 26' and 27 and 27' of the silicon oxide film 21 formed at the above-described step (FIG. 6II) are lost (FIG. 6IV).

Then, parts of the silicon oxide patterns 21 and 21' of the first and second pressure generation chambers 3 and 4 and the first and second ink supply ports 6 and 7 to be formed by half etching are left, and windows 30 and 30' and 31 and 31' for anisotropic etching of the reservoir 5 to be formed as a through hole and the nozzle communication hole 10 are formed on the surface and rear. A small-diameter through hole 32 for forming the nozzle communication hole 10 is bored by a YAG laser, etc.

When the silicon monocrystalline substrate 20 is immersed in a water solution of 20% potassium hydroxide (KOH) by weight maintained at 80° C. and anisotropic etching is executed, the area becoming the reservoir 5 is gradually etched from the full faces of the windows 30 and 30', the area becoming the nozzle communication hole 10 is gradually etched from the leading through hole 32, and the silicon oxide film 21' left by the half etching also undergoes etching and is lost (FIG. 7I).

When etching further proceeds, a through hole 33 is made to form the reservoir, a through hole 34 spread and opened to one face and partitioned by a face of rough plane orientation <111> to form the nozzle communication hole 10, and concaves 35 and 36 are formed in the areas to form the pressure generation chambers 3 and 4 and the ink supply ports 6 and 7 (FIG. 7II). Last, when the silicon oxide film 21 is etched and removed, the flow passage formation substrate 1 is complete (FIG. 7III).

If the leading through hole 32 is made before anisotropic etching is executed as in the embodiment, a through hole narrower than the pressure generation chamber can be made, degradation of the rigidity of the flow passage formation substrate 1 can be suppressed as much as possible, and cross talk can be prevented from occurring.

Figure 8:
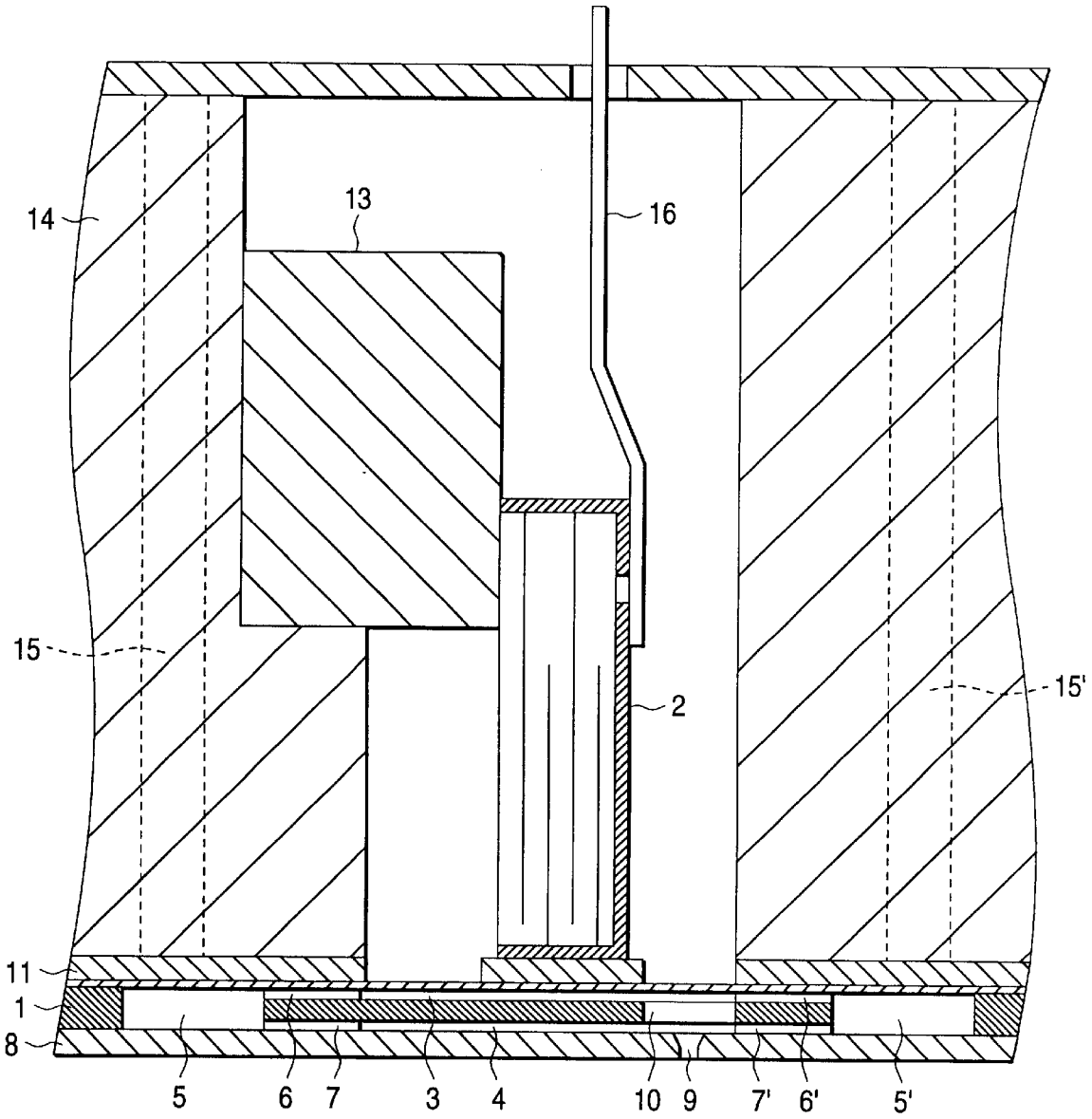
FIG. 8 is a sectional view to show another embodiment of the invention.

In the embodiment, ink is supplied from one side of the pressure generation chamber 3, 4. However, a similar effect is produced if the invention is applied to an ink jet recording head wherein a second reservoir 5' is also provided in opposite ends in the axial direction of the pressure generation chambers 3 and 4 and ink is also supplied from the reservoir 5' through ink supply ports 6' and 7', as shown in FIG. 8.

Figure 9:
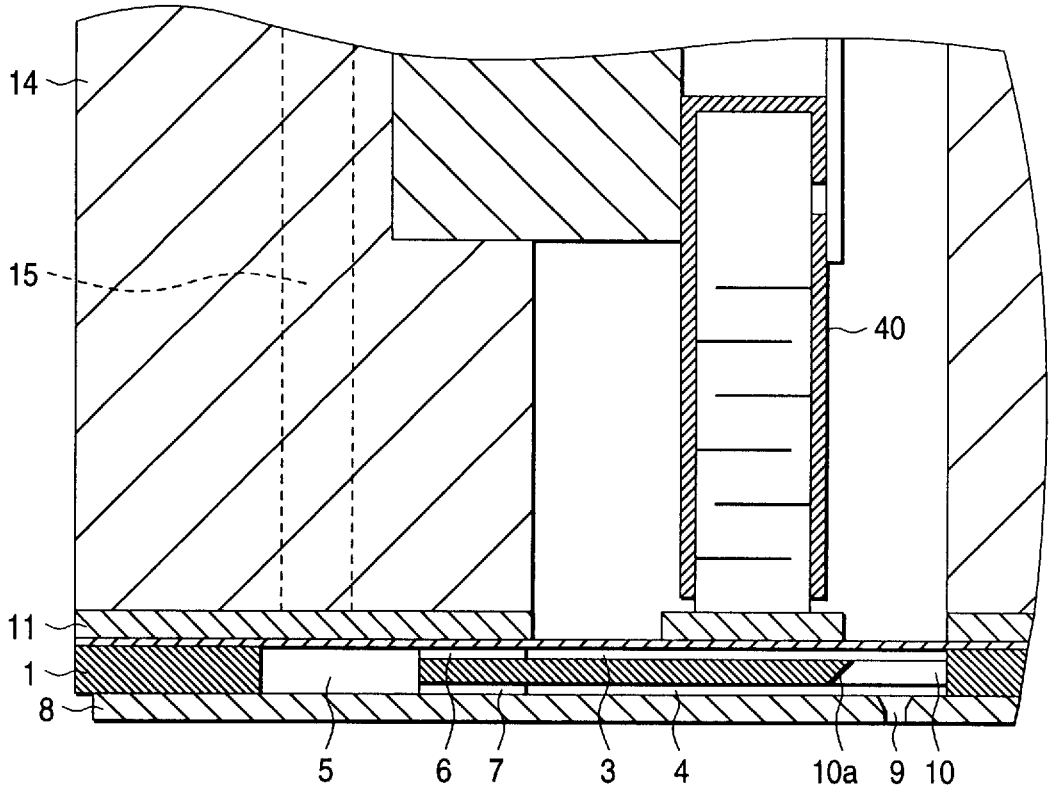
FIGS. 9 and 10 are drawings to show application examples to ink jet recording heads of other shapes.

In the embodiment, the piezoelectric vibrator of piezoelectric constant d31 comprising internal electrodes and piezoelectric material deposited in parallel to the axial direction is taken as an example. However, it is apparent that a similar effect is produced if a piezoelectric vibrator 40 of piezoelectric constant d33 comprising internal electrodes and piezoelectric material deposited in a direction perpendicular to the axial direction is used, as shown in FIG. 9.

Figure 10:
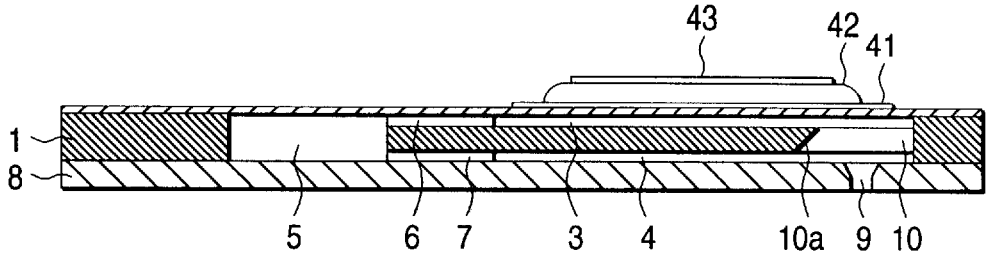

In the embodiment, use of the piezoelectric vibrator 2 for applying pressure in a perpendicular direction to the elastic plate 11 is taken as an example. However, it is apparent that a similar effect is produced if the elastic plate 11 is formed on a surface with a lower electrode 41 as required, namely, if the elastic plate is formed of a nonconductive material. In this case, a piezoelectric layer 42 is formed at a position opposed to the pressure generation chamber 3 on the surface of the lower electrode 41 by sputtering a piezoelectric material, bonding a green sheet of a piezoelectric material, etc., an upper electrode 43 is formed on the surface of the piezoelectric layer 42, and the piezoelectric layer 42 is bent and displaced for selectively deforming only the area of the pressure generation chamber 3, as shown in FIG. 10.

Figure 11A:
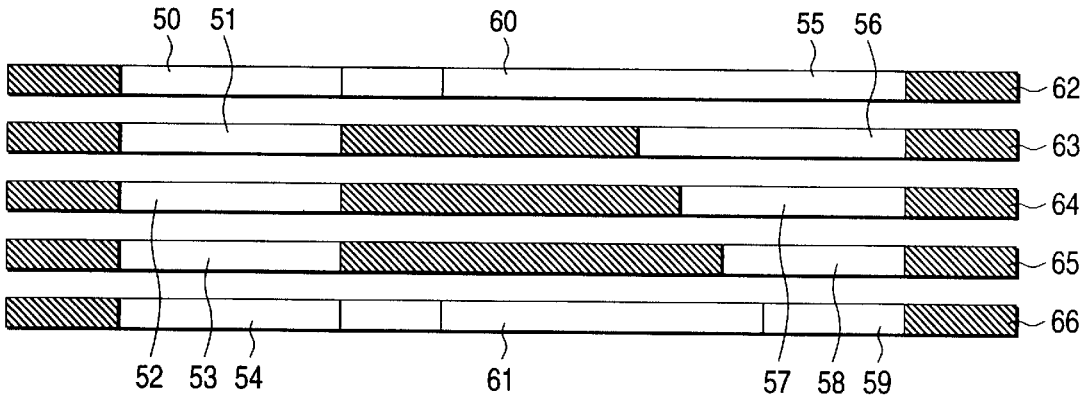
FIGS. 11A and 11B are drawings to show an embodiment of forming a flow passage formation substrate by laminating plate materials and show shapes of plate members and a state in which the plate members are laminated.

In the embodiment, a single plate member is etched to form concaves and through holes for producing the pressure generation chambers, the reservoir, the nozzle communication hole, etc. However, as shown in FIG. 11A, the flow passage formation substrate 1 is divided into at least four layers (in the example, five layers) in a thickness direction and films 62 to 66 formed with through holes 50 to 59 forming the reservoir 5 and the nozzle communication hole 10 of the flow passage formation substrate 1 and through holes 60 and 61 as concaves forming the first and second pressure generation chambers 3 and 4 and the first and second ink supply ports 6 and 7 are provided.

Figure 11B:
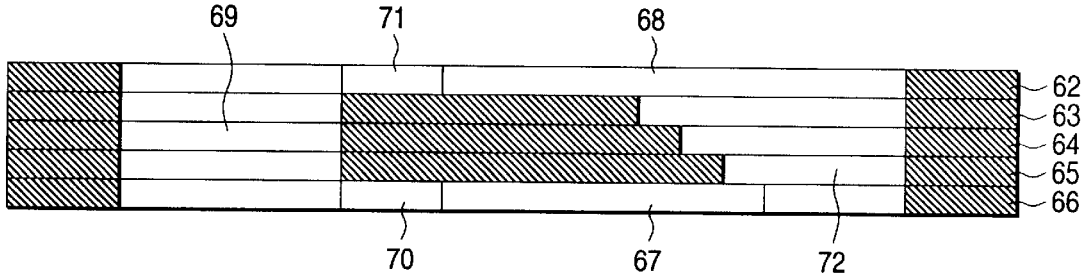

These films 62 to 66 are laminated on each other as shown in FIG. 11B, whereby first and second pressure generation chambers 67 and 68, a reservoir 69, first and second ink supply ports 70 and 71, and a nozzle communication hole 72 can be formed. If photosensitive dry films, for example, are used as the films 62 to 66, through holes of desired shapes can be easily made with high accuracy by exposure and etching and the films are brought into intimate contact with each other because of self-bonding property; they become optimum materials.

Figure 12:
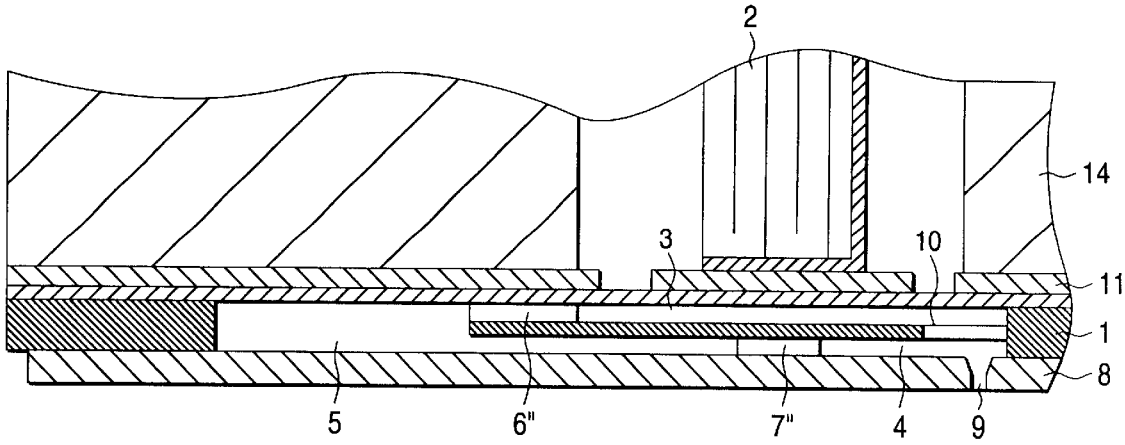
FIG. 12 is a sectional view to show another embodiment of an ink jet recording head of the invention.

FIG. 12 shows another embodiment of the invention. A piezoelectric vibrator 2 axially expanded and contracted as a pressure generation means is fixed to a head holder 14 in a state in which it is abutted at the tip against an elastic plate 11 forming a part of a flow passage unit. This flow passage unit comprises the elastic plate 11, a flow passage formation substrate 1, and a nozzle plate 8 having a nozzle opening 9, the members 11, 1, and 8 being deposited.

Figure 13A:
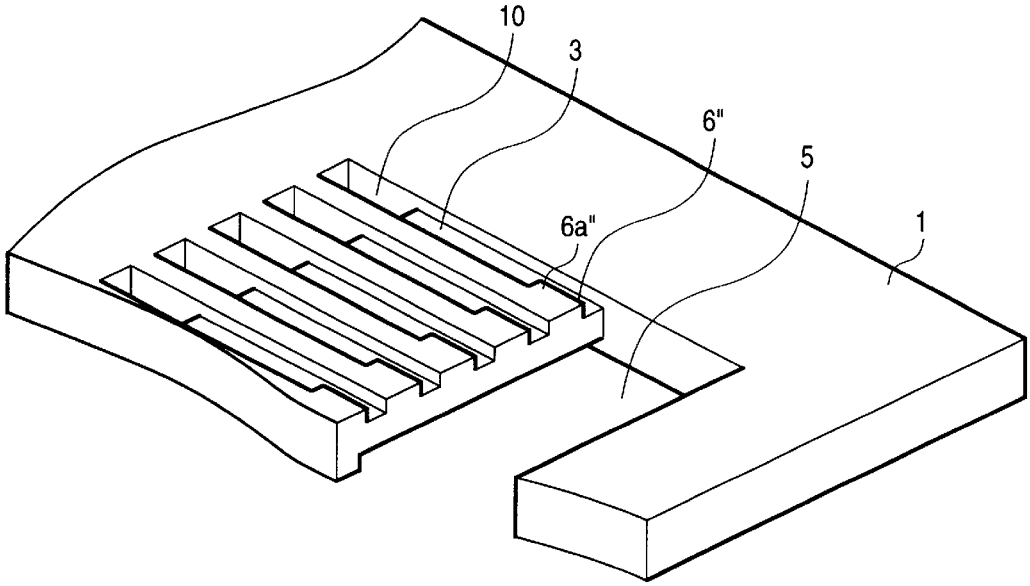
FIGS. 13A and 13B are enlarged perspective views of neighborhoods of ink supply ports of a flow passage formation substrate of the recording head in FIG. 12.
Figure 13B:
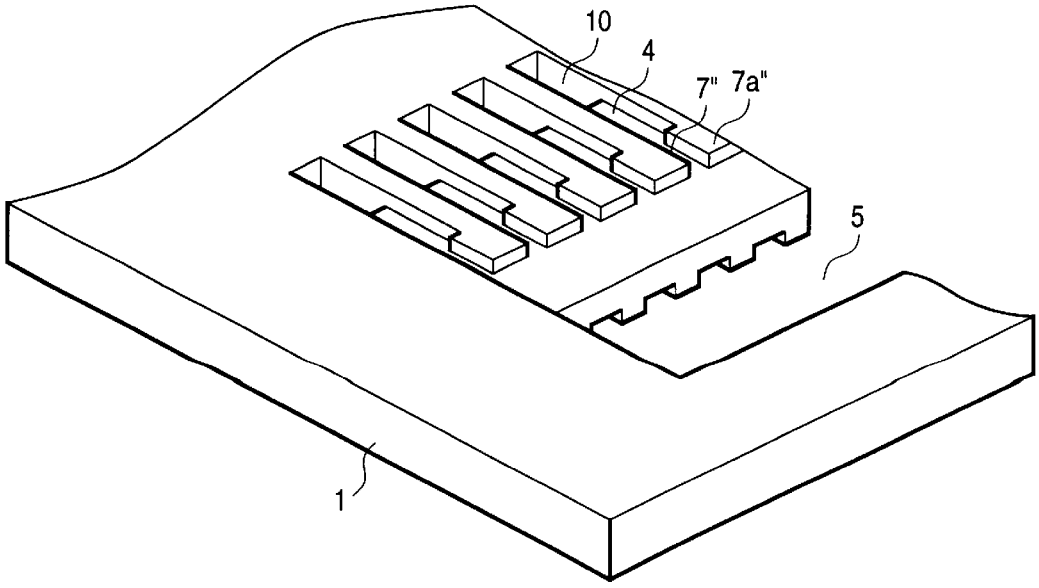

The flow passage formation substrate 1 is formed with a reservoir 5 formed as a through hole, first and second pressure generation chambers 3 and 4 as concaves formed on the piezoelectric vibrator 2 side and the nozzle plate 8 side, respectively, a first ink supply port 6" formed as a concave communicating with the first pressure generation chamber 3, a second ink supply port 7" communicating with the second pressure generation chamber 4, and a nozzle communication hole 10 as a through hole made at a position opposed to the nozzle opening 9, as shown in FIGS. 13A and 13B.

The first and second ink supply ports 6" and 7" are formed with convexes 6*a"* and 7*a"* each projecting from one wall face to another wall face to give flow passage resistance, and the second ink supply port 7" is positioned closer to the nozzle opening 9 rather than to the first ink supply port 6". As the second ink supply port 7" leans to the nozzle opening 9 side, the face on the nozzle opening side of the reservoir 5 is widened accordingly.

In the embodiment, when the piezoelectric vibrator 2 is contracted and the first pressure generation chamber 3 is expanded, ink in the reservoir 5 flows into the first pressure generation chamber 3 from the first ink supply port 6" and flows into the second pressure generation chamber 4 from the second ink supply port 7".

At this time, since the second ink supply port 7" is positioned on the nozzle opening side, flow passage resistance is low and the second pressure generation chamber 4 is promptly filled with ink. From here, ink also flows into the first pressure generation chamber 3 through the nozzle communication hole 10.

At the stage of the termination of filling the first and second pressure generation chambers 3 and 4 with ink, the piezoelectric vibrator 2 is expanded and the elastic plate 11 is pressed against the nozzle plate side. At this time, ink flows into the second pressure generation chamber 4 through the nozzle communication hole 10 and an ink drop is jetted through the nozzle opening 9.

After the ink drop is jetted, the piezoelectric vibrator 2 is restored to the former state and the first pressure generation chamber 3 is expanded. Since the second ink supply port 7" is positioned on the nozzle opening side, flow passage resistance is low and the first pressure generation chamber 3 is promptly filled with ink through the second pressure generation chamber 4 and the nozzle communication hole 10. Also, since the second ink supply port 7" has smaller flow passage resistance than the first ink supply port 6", the capability of filling with ink is enhanced.

Figure 14A:
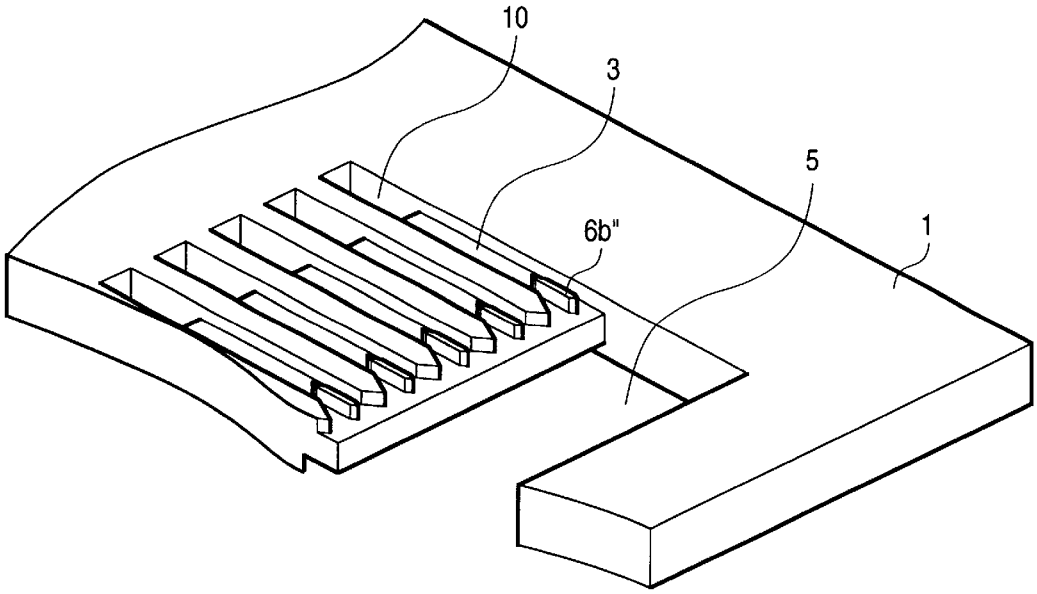
FIGS. 14A and 14B are perspective views of another embodiment of a recording head of the invention as structures of neighborhoods of ink supply ports of a flow passage formation substrate.
Figure 14B:
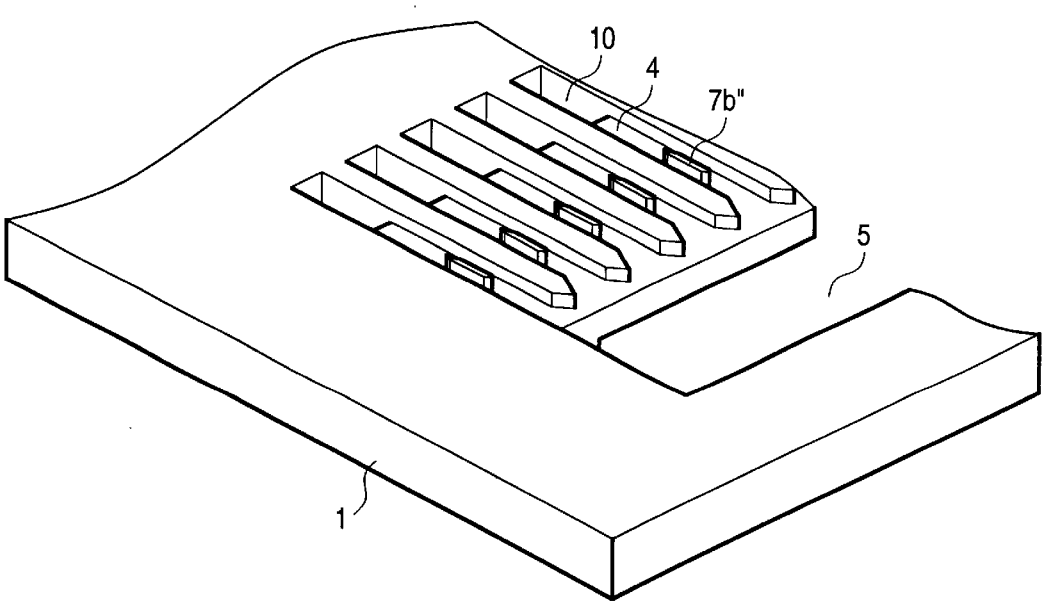

In the embodiment, the convexes 6*a*″ and 7*a*″ are formed for giving flow passage resistance fitted as the ink supply ports 6" and 7". However, a similar effect is produced if at least one island part 6*b*″, 7*b*″ is formed in each ink supply port formation area as shown in FIGS. 14A and 14B.

The island 7*b*″ formed in the second ink supply port is formed at a position near the nozzle communication hole 10 as much as possible. The second ink supply port 7" is thus formed on the nozzle communication hole 10 side, whereby the whole volume of the pressure generation chamber can be decreased and compliance caused by compressability of ink can be reduced without changing the ink drop jetting capability. When the compliance of the pressure generation chamber is reduced, the Helmholtz resonance frequency rises, the drive frequency and the ink drop fly speed can be improved, and area modulation according to one dot, namely, gradation, can be enhanced.

Figure 15:
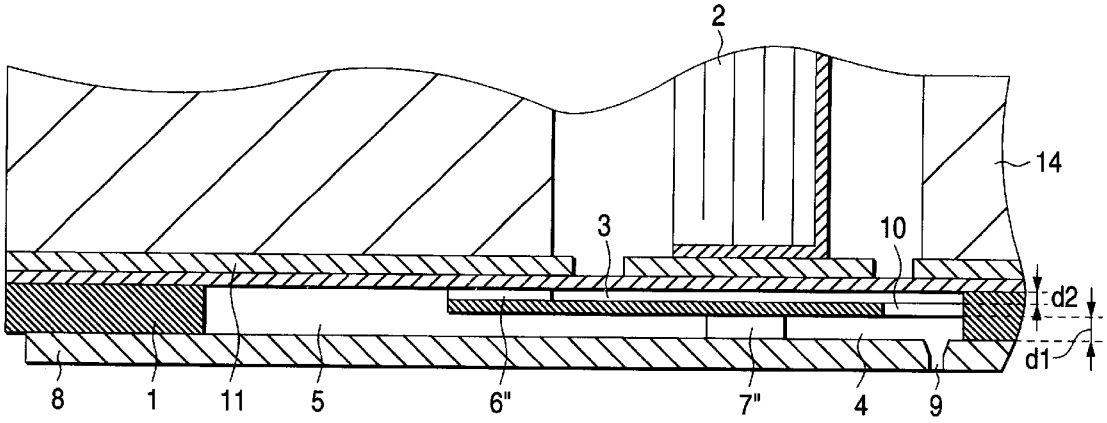
FIGS. 15 and 16 are sectional views to show other embodiments of the invention.

FIG. 15 shows another embodiment of the invention. Depth d1 of a second pressure generation chamber 4 positioned on the side of a nozzle plate 8 is larger than depth d2 of a first pressure generation chamber 3 positioned on the side of a piezoelectric vibrator 2.

According to the embodiment, the ink flow speed into the second pressure generation chamber 4 can be increased and in addition, the reservoir volume can be enlarged and cross talk can be prevented.

Figure 16:
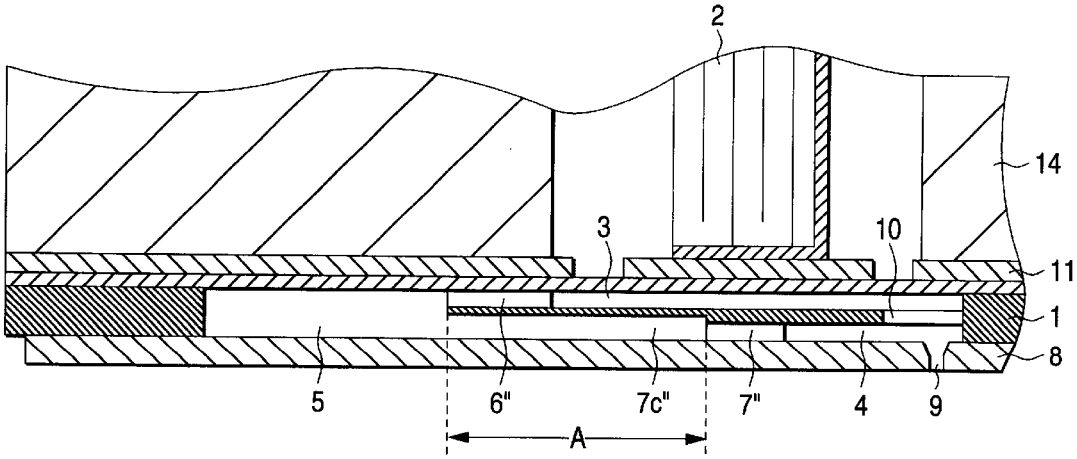

FIG. 16 shows another embodiment of the invention. In the embodiment, a concave 7"*c* is formed in an area A connecting a second ink supply port 7" and a reservoir 5 for lowering resistance of the flow passage from the reservoir 5 to the second ink supply port 7" as much as possible. According to the embodiment, the ink flow speed into the second pressure generation chamber 4 can be increased and cross talk can be prevented.

If such a flow passage formation substrate is made of a silicon monocrystalline substrate, it can be formed by half etching of the area A redundantly.

Figure 17:
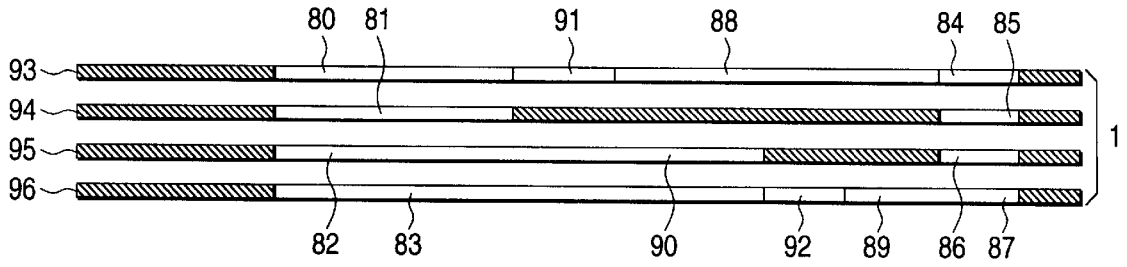
FIG. 17 is a drawing to show a manufacturing method of a flow passage formation substrate of a recording head.
Figure 18:
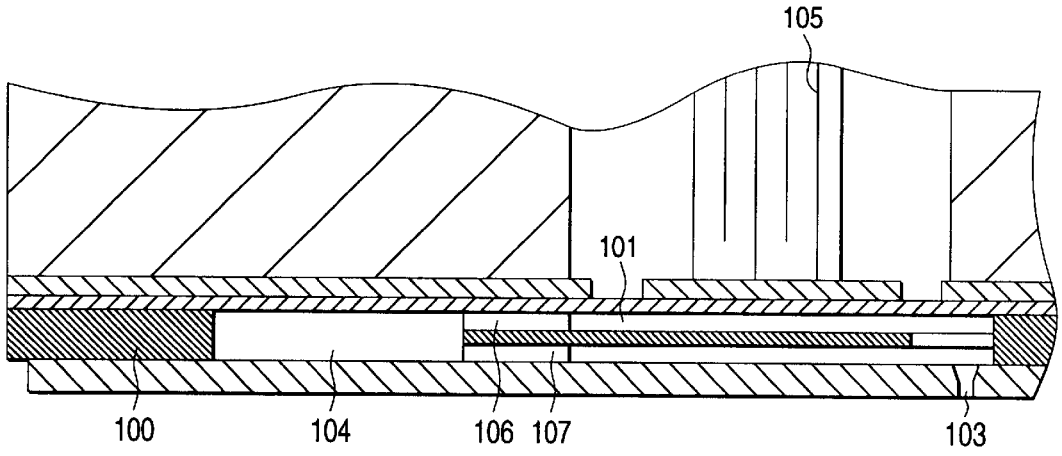
FIG. 18 is a sectional view to show an example of an ink jet recording head in a related art.
Figure 8:
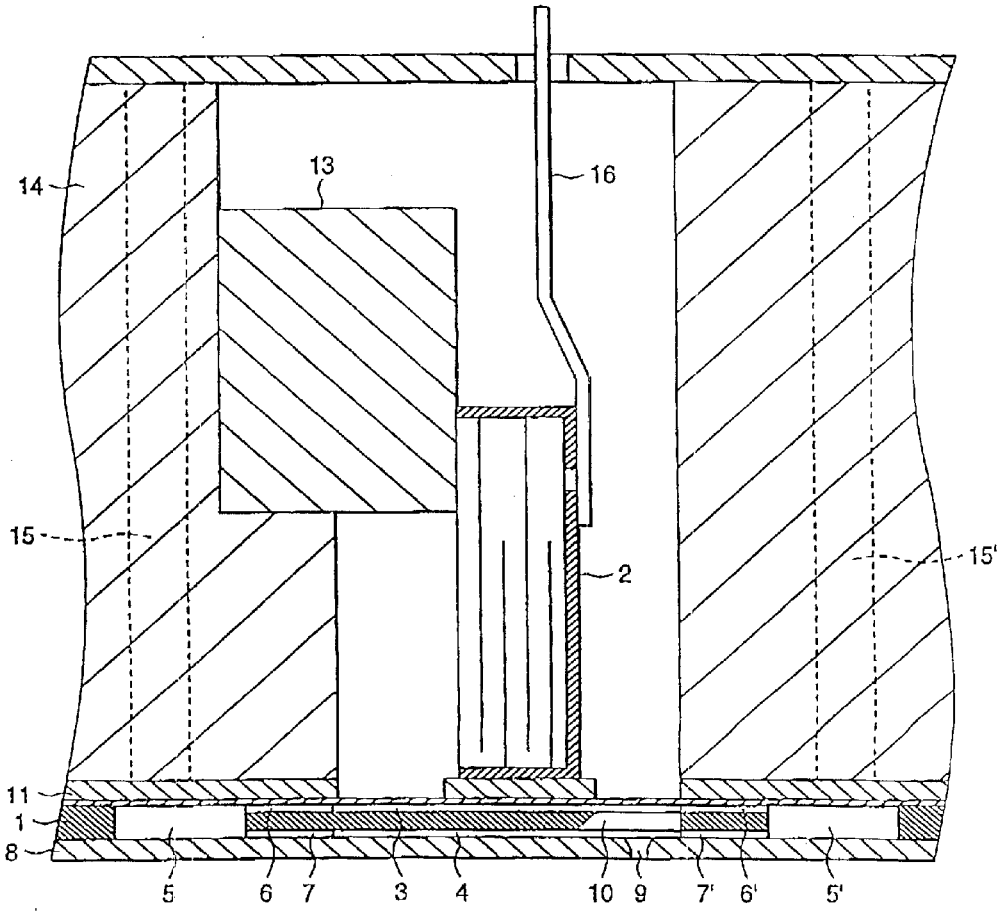

As shown in FIG. 17, a flow passage formation substrate 1 is divided into at least four layers in a thickness direction and plate members 93 to 96 formed with through holes 80 to 92 forming a reservoir 5, a nozzle communication hole 10, first and second pressure generation chambers 3 and 4, an area corresponding to a concave 7"*c* of area A, and first and second ink supply ports 6" and 7" of the flow passage formation substrate 1 are provided and can be laminated on each other with an adhesive. A material that can be etched and has durability against ink, for example, a stainless steel sheet can be used for such films. Particularly, photosensitive dry films become optimum materials because through holes of desired shapes can be easily made with high accuracy by exposure and etching and the films are brought into intimate contact with each other because of self-bonding property.

In the above-described embodiment, the recording head using the piezoelectric vibrator in a longitudinal vibration mode as pressure generation means is taken as an example. However, if two pressure generation chambers are formed for one nozzle opening and pressure is applied to ink in one pressure generation chamber by a piezoelectric vibrator in a bend mode or a heating element, it is apparent that a similar effect is produced if the invention is applied to it.

What is claimed is:

1. An ink jet print head comprising:

a reservoir for storing supplied ink, first pressure generating chambers facing an elastic plate, first ink supply ports for supplying ink to said first pressure chambers, second pressure chambers facing a nozzle plate, second ink supply ports for supplying ink to said second pressure generating chambers, a flow path forming substrate having nozzle communicating holes, wherein a width of said nozzle communicating holes increases in a direction toward a nozzle opening side of said flow path forming substrate, wherein said first pressure generating chambers communicate with said second pressure generating chambers, said nozzle plate has nozzle openings and seals a first surface of said flow path forming substrate, and said elastic plate seals a second surface of said flow path forming substrate.

2. The ink jet recording head as claimed in claim 1, wherein an opening area of the nozzle communication hole on the nozzle opening side is formed larger than an opening area of the nozzle communication hole on the elastic plate side.

3. The ink jet recording head as claimed in claim 1, wherein said flow passage formation substrate is formed by executing anisotropic etching of a silicon monocrystalline substrate.

4. The ink jet recording head as claimed in claim 3, wherein the silicon monocrystalline substrate has a <110> plane orientation.

5. The ink jet recording head as claimed in claim 3, wherein the first and second pressure generation chambers are formed by executing half etching of a silicon monocrystalline substrate.

6. The ink jet recording head as claimed in claim 3, wherein said flow passage formation substrate is a silicon monocrystalline substrate having a thickness ranging from 300 $\mu$m to 600 $\mu$m.

7. The ink jet recording head as claimed in claim 1, wherein said pressure generation means is a piezoelectric vibrator which expands and contracts axially.

8. The ink jet recording head as claimed in claim 1, wherein said pressure generation means is a piezoelectric vibrator which is bent and displaced to selectively deform said pressure generating chambers.

9. An ink jet print head as claimed in claim 1, wherein said nozzle communication holes are comprised by a smooth plane.

10. An ink jet print head as claimed in claim 1, wherein a width of said nozzle communication holes is the same or narrower than that of said first and second pressure generating chambers.

11. An ink jet print head as claimed in claim 1, wherein said nozzle communication holes are formed and positioned at an area where one end of said first pressure generating chambers communicates with said second pressure generating chambers.

12. The ink jet recording head as claimed in claim 1, wherein the nozzle communication hole is partitioned by a plane having a substantially (111) plane orientation.

13. An inkjet print head as claimed in claim 12, the ink path forming substrate comprises layers which are photosensitive dry films.

14. An ink jet print head as claimed in claim 1, wherein said flow path forming substrate is composed of at least four layers having through holes.

15. An ink jet print head as claimed in claim 1, wherein said nozzle openings are faced said nozzle communication holes.

16. An ink jet print head comprising a pressure generating means and flow path unit having an elastic plate, a flow path forming substrate and a nozzle plate having nozzle openings, said flow path forming substrate comprising a reservoir for storing supplied ink, first pressure generating chambers formed in the vicinity of said pressure generating means in a concave shape, second pressure generating chambers formed in the vicinity of said nozzle plate in a concave shape, first ink supply ports for supplying ink to said first pressure generating chambers, second ink supply ports for supplying ink to said second pressure generating chambers and formed closer to said nozzle openings than said first ink supply ports, and at least one nozzle communication hole for communicating said first pressure generating chambers with said second pressure generating chambers.

17. The ink jet recording head as claimed in claim 16, wherein the reservoir is formed as a through hole in the flow passage formation substrate.

18. The ink jet recording head as claimed in claim 16, wherein the first ink supply port is positioned in proximity to the reservoir.

19. The ink jet recording head as claimed in claim 16, wherein each of the nozzle openings is formed at a position opposed to a respective one of the second pressure generating chambers.

20. The ink jet recording head as claimed in claim 16, wherein the nozzle openings are formed at a position opposed to the nozzle communication hole.

21. The ink jet recording head as claimed in claim 16, wherein the flow passage formation substrate is formed by executing anisotropic etching of a silicon monocrystalline substrate.

22. The ink jet recording head as claimed in claim 16, wherein the side of the reservoir where the second ink supply ports are formed is widened partially.

23. The ink jet recording head as claimed in claim 16, wherein the first and second pressure generation chambers are placed in parallel so as to overlap.

24. The ink jet recording head as claimed in claim 16, wherein a length of the first pressure generating chambers in a length direction thereof is formed longer than a length of the second pressure generating chambers in a length direction thereof.

25. The ink jet recording head as claimed in claim 16, wherein said pressure generation means is disposed at a position opposed to the first pressure generation chambers.

26. The ink jet recording head as claimed in claim 16, wherein the flow passage formation substrate comprises a plurality of thin plates formed with through holes at positions corresponding to the reservoir, the first and second pressure generation chambers, the first ink supply ports the second ink supply ports, and the nozzle communication holes, the thin plates being laminated on each other.

27. The ink jet recording head as claimed in claim 26, wherein the thin plates are stainless steel plates.

28. The ink jet recording head as claimed in claim 26, wherein the thin plates are photosensitive dry films.

29. The ink jet recording head as claimed in claim 16, wherein the flow passage formation substrate is formed by executing anisotropic etching of a <110> plane of a silicon monocrystalline substrate.

30. The ink jet recording head as claimed in claim 16, wherein the concaves are formed by executing half etching of a <110> plane of a silicon monocrystalline substrate.

31. The ink jet recording head as claimed in claim 16, wherein convexes are formed with said first and second ink supply ports, said convexes project from a wall thereof, thereby creating flow passage resistance.

32. The ink jet recording head as claimed in claim 16, wherein island parts are formed in said first and second ink supply ports.

33. The ink jet recording head as claimed in claim 16, wherein concaves are formed in an area connecting said second ink supply ports and said reservoirs, thereby lowering the resistance from the reservoirs to the second ink supply ports.

34. An ink jet print head as claimed in claim 16, wherein volume of said second pressure generating chambers is larger than that of said first pressure generating chambers.

35. An ink jet print head as claimed in claim 16, wherein concave parts are formed between said reservoir and said second ink supply ports.

36. An ink jet print head as claimed in claim 16, wherein an ink flow resistance of said first ink supply ports is larger than that of said second ink supply ports.

37. An ink jet print head as claimed in claim 16, wherein said nozzle communication holes are formed for communicating one end of said first pressure generating chambers with one end of said second pressure generating chambers.

38. In ink jet print head claimed in claim 16, wherein a distance from said nozzle plate to said flow path forming substrate is larger than that of said second pressure generating chambers in the area from said reservoir to said second ink supply ports.

39. An ink jet printing apparatus having a print head, comprising:

a reservoir for storing supplied ink, first pressure generating chambers facing an elastic plate, first ink supply ports for supplying ink to said first pressure chambers, second pressure chambers facing a nozzle plate, second ink supply ports for supplying ink to said second pressure generating chambers, a flow path forming substrate having nozzle communicating holes, wherein a width of said nozzle communicating holes increases in a direction toward a nozzle opening side of said flow path forming substrate, wherein said first pressure generating chambers communicate with said second pressure generating chambers, said nozzle plate has nozzle openings and seals a first surface of said flow path forming substrate, and said elastic plate seals a second surface of said flow path forming substrate.

* * * * *

UNITED STATES PATENT AND TRADEMARK OFFICE

CERTIFICATE OF CORRECTION

PATENT NO. : 6,322,203 B1
DATED : November 27, 2001
INVENTOR(S) : Tsuyoshi Kitahara It is certified that error appears in the above-identified patent and that said Letters Patent is hereby corrected as shown below:

Drawings,
Drawing sheet, consisting of Fig. 8, should be deleted to be replaced with the drawing sheet, consisting of Fig. 8, as shown on the attached page.

Signed and Sealed this

First Day of October, 2002

*Attest:*

*Attesting Officer*

JAMES E. ROGAN
*Director of the United States Patent and Trademark Office*